US007226645B1

(12) United States Patent
Braithwaite

(10) Patent No.: US 7,226,645 B1
(45) Date of Patent: Jun. 5, 2007

(54) PORTABLE PERSONAL PALM TREE

(76) Inventor: Mary M. Braithwaite, 3944 Holin La., North Port, FL (US) 33730

( * ) Notice: Subject to any disclaimer, the term of this patent is extended or adjusted under 35 U.S.C. 154(b) by 343 days.

(21) Appl. No.: 10/638,241

(22) Filed: Aug. 11, 2003

(51) Int. Cl.
*A41G 1/00* (2006.01)

(52) U.S. Cl. ..... 428/18; 428/8; 428/12; 428/20; 211/190; 211/196; 211/197

(58) Field of Classification Search ..... 428/7, 428/8, 18, 19, 23, 9, 12, 20; 211/62, 117, 211/190, 196, 197, 205
See application file for complete search history.

(56) References Cited

U.S. PATENT DOCUMENTS 3,713,957 A * 1/1973 Hermanson ..... 428/9
5,085,900 A * 2/1992 Hamlett ..... 428/18
6,591,433 B1 * 7/2003 Sager ..... 4/615
2002/0095947 A1 * 7/2002 Treppedi et al. ..... 62/457.9

FOREIGN PATENT DOCUMENTS

JP 07-313230 * 12/1995

* cited by examiner

*Primary Examiner*—Jennifer McNeil
*Assistant Examiner*—G. Blackwell
(74) *Attorney, Agent, or Firm*—Frank A. Lukasik

(57) ABSTRACT

An artificial palm tree constructed from modular components which are combined in various ways to produce a palm tree having different characteristics for use as a beach umbrella. The palm tree consists of a base, a trunk mounted on the base, a tree heart mounted on the trunk, and a leaf/canopy component attached to a collar for opening and closing the leaf/canopy component. The leaf/canopy, the trunk, and the tree heart may be stored in the base.

1 Claim, 9 Drawing Sheets

PORTABLE PERSONAL PALM TREE

BACKGROUND OF THE INVENTION

Field of the Invention

The present invention relates to decorative artificial palm trees and, more particularly, to a palm tree constructed from modular components which are combined in various ways to produce trees having different characteristics and which can be variously assembled for decorative, theme or protective purposes.

Prior art references abound for umbrella/palm tree configurations including U.S. Pat. No. 6,318,391 issued to Ching-Chuan You which is typical of the prior art in that it teaches the use of palm leaf shaped canopy sections supported by a central spine. The ubiquitous palm tree shares in common with all species thereof, a distinctive canopy of leaves supported by a central trunk. The trunk and leaf components vary among palm tree varieties and define the various species thereby.

Commercialization of the Palm tree as a symbol has made it synonymous with exotic travel, recreation and even boisterous celebration. As the Christmas tree has come to symbolize the celebration of a winter holiday season, so too has the palm become a symbol of a summer holiday season.

The present invention seeks to provide the components for an individual to assemble a personal palm tree in a variety of specie specific styles such that a passable facsimile of the palm tree is created to lend decoration and or atmosphere to an environment. Such a palm tree would, if desired, provide a measure of shelter to the sun offering thereby a novel and useful alternative to the beach umbrella. The invention seeks also to provide a selection of palm tree components such as trunks, bases, hearts, leaf canopies and even functional simulations of "cocoanuts" which could serve as beverage containers.

SUMMARY OF THE INVENTION

It is an object of the invention to provide an artificial palm tree from components which may be "mixed and matched" so as to provide a decorative and/or protective facsimile thereof.

It is a further object of the invention to provide a palm tree which is portable, the components of which can be nested within each other to facilitate transport and assembly.

It is a further object of the invention to provide a variety of palm tree components so as to provide multiple choices to the user as to the type or variety of tree produced.

It is a further object of the invention to provide an anchoring or attachment means whereby the tree will remain in a vertical position once assembled.

The present invention provides a portable artificial palm comprised of a hollow trunk portion made of a plurality of sections. The upper trunk portions are formed from a flexible moldable substance with bark patterns embedded upon the outer surfaces. Each of these upper sections are split longitudinally to allow the section to collapse to a smaller diameter for storage in the trunk base. The trunk base is hollow to provide a storage area for the collapsible leaf/sunscreen and the upper trunk segments. The trunk provides a receptacle into which water or sand may be placed to add ballast to the assembled tree. A second embodiment has a mounting hole formed in the base which may be combined with a ground anchoring mechanism to secure the tree against heavy winds. Tongued protrusions from the upper and lower faces of the upper segments engage and snap into openings in adjacent sections to provide attachment means between segments. The upper leaf canopy can be variously decorated to resemble different palm tree species. A diaphanous base membrane may be optionally fitted to provide a contiguous shade surface not otherwise possible with discrete and separate leaf components.

DETAILED DESCRIPTION OF A PREFERRED EMBODIMENT

Figure 1:
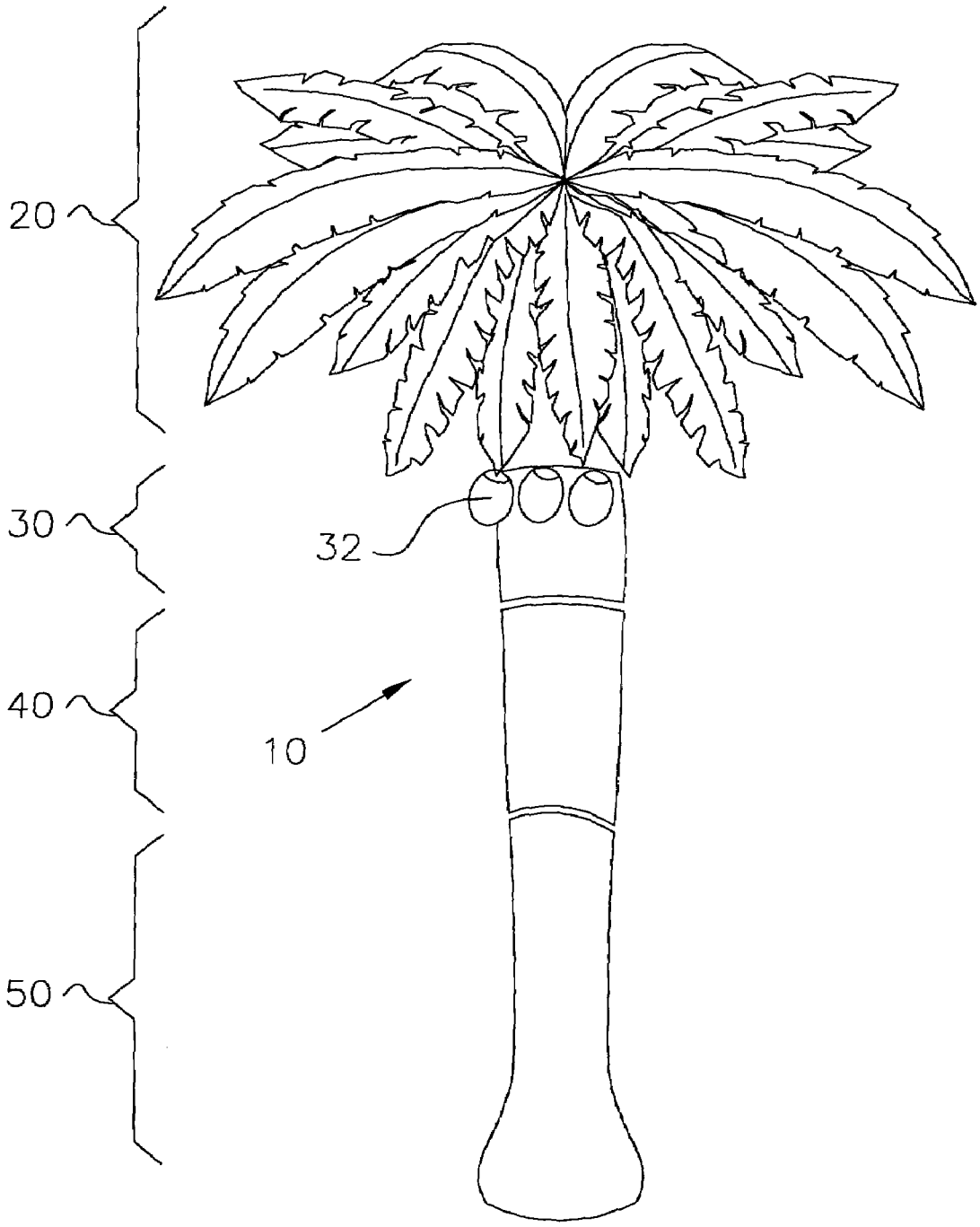
FIG. 1 is an elevational view of the invention showing the separate components of which it is composed.

Referring now to the drawings in which like numerals designate like and corresponding parts throughout the several views, in FIG. 1 the invention is designated overall by the numeral 10. The leaf/canopy component is designated by bracket 20, the heart of the tree by bracket 30, the trunk of the tree by the numeral 40 and the base by the numeral 50.

Figure 2:
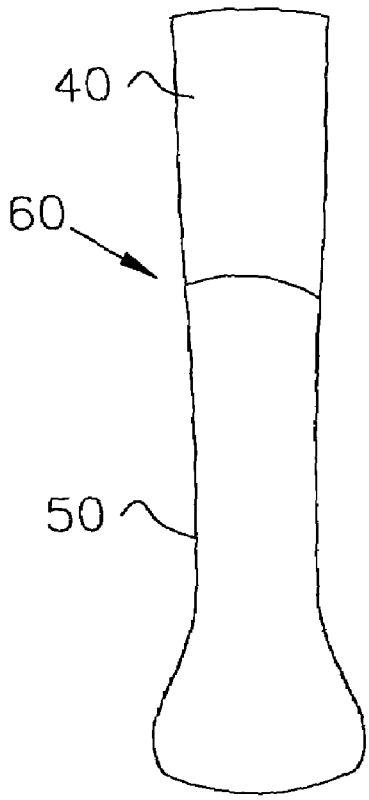
FIGS. 2 and 3 are closer elevational views, partially in section, showing the manner in which the trunk units are attached together.
Figure 3:
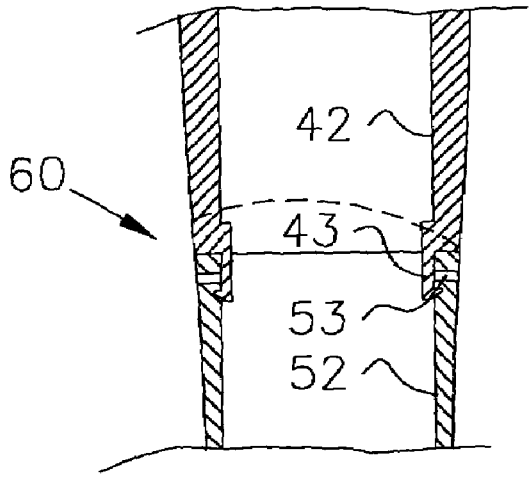

In FIG. 2, snap joint 60 is shown and in FIG. 3, the component parts of which are male member 43 and release aperture 53. Units 40 and 50 are joined by snapping them together to engage the male and female portions thereof.

Figure 4:
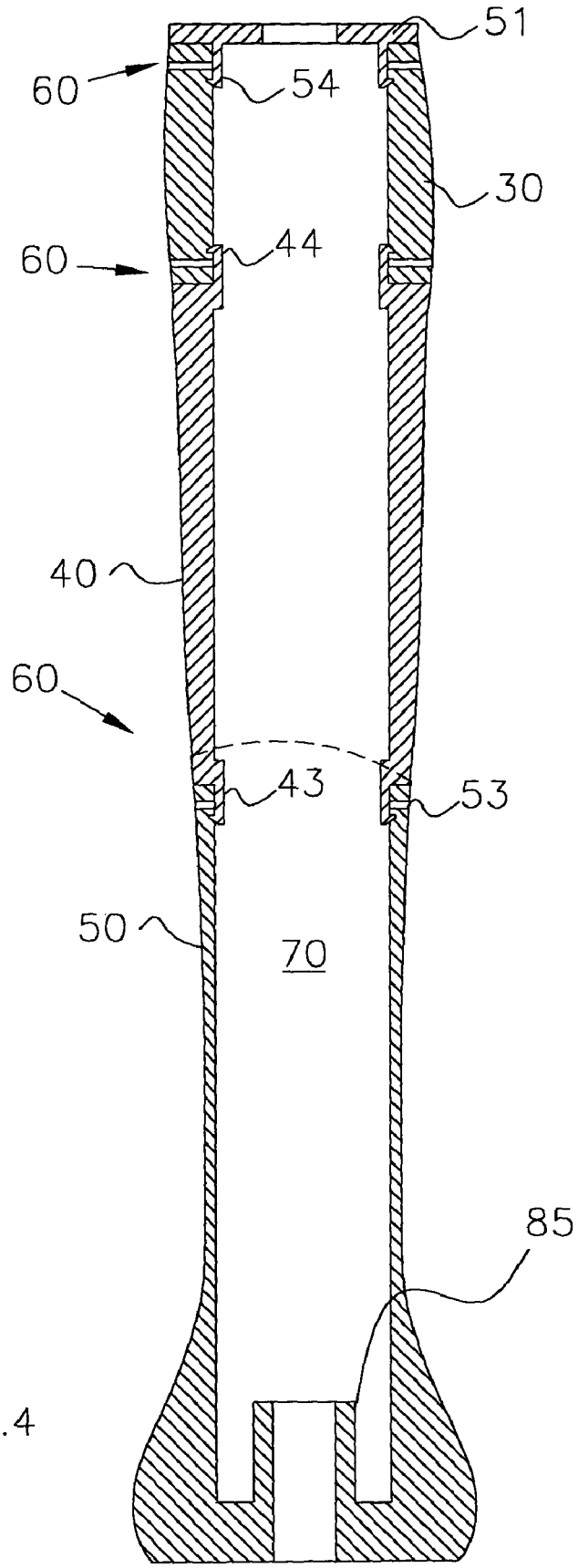
FIG. 4 is a sectional, elevational view of the assembled trunk components.
Figure 5:
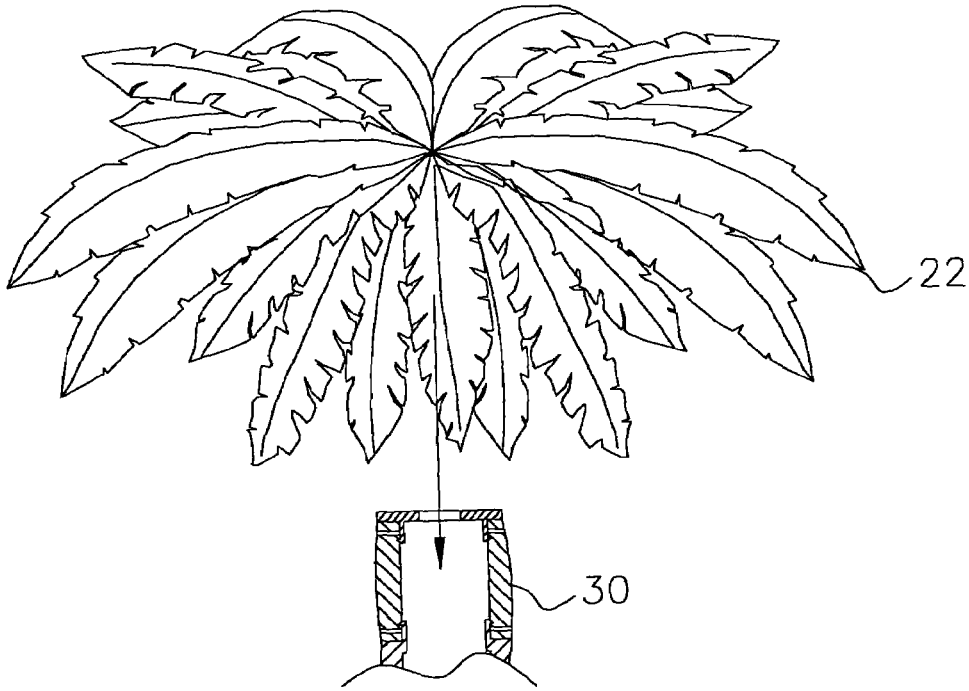
FIG. 5 is a view of the leaf/canopy component as it is deployed just prior to storage within the upper trunk section.
Figure 6:
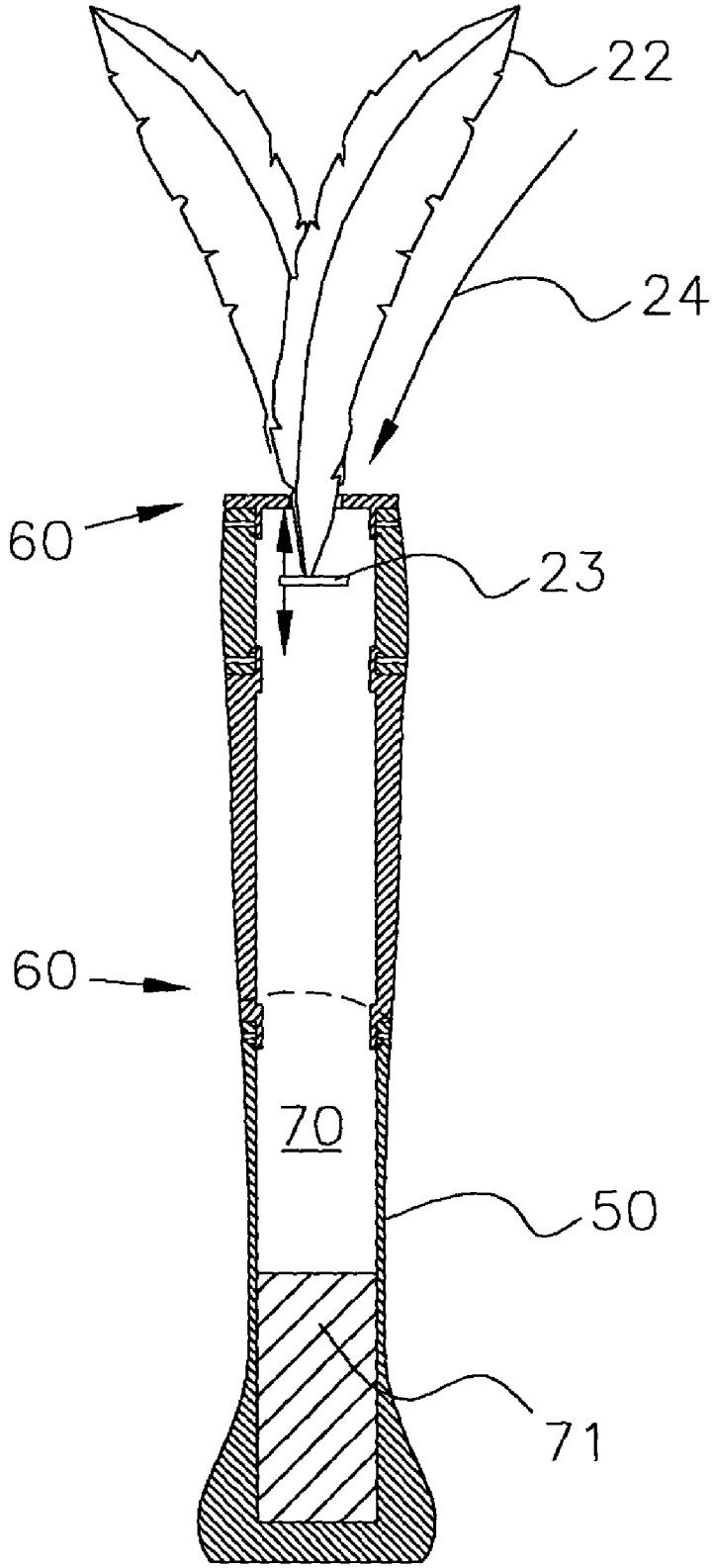
FIG. 6 is an elevational view of the trunk as the leaf/canopy component is collapsed and folded within.

In FIG. 4, the assembled components form the tree trunk capped by cover 51. A hollow protrusion 85 is formed to accommodate a sand grabber 80, or pole to go into the sand to hold the personal palm tree 10 (PALMBRELLA™). The trademark PALMBRELLA is owned by the Applicant. In a second embodiment, FIG. 6 shows hollow interior 70 awaiting the introduction of sand or water ballast 71. The leaf/canopy component 20 is not shown in this view although in operation, it will have been offered up to the center opening of cap 51 (FIGS. 5 and 6)

Figure 7:
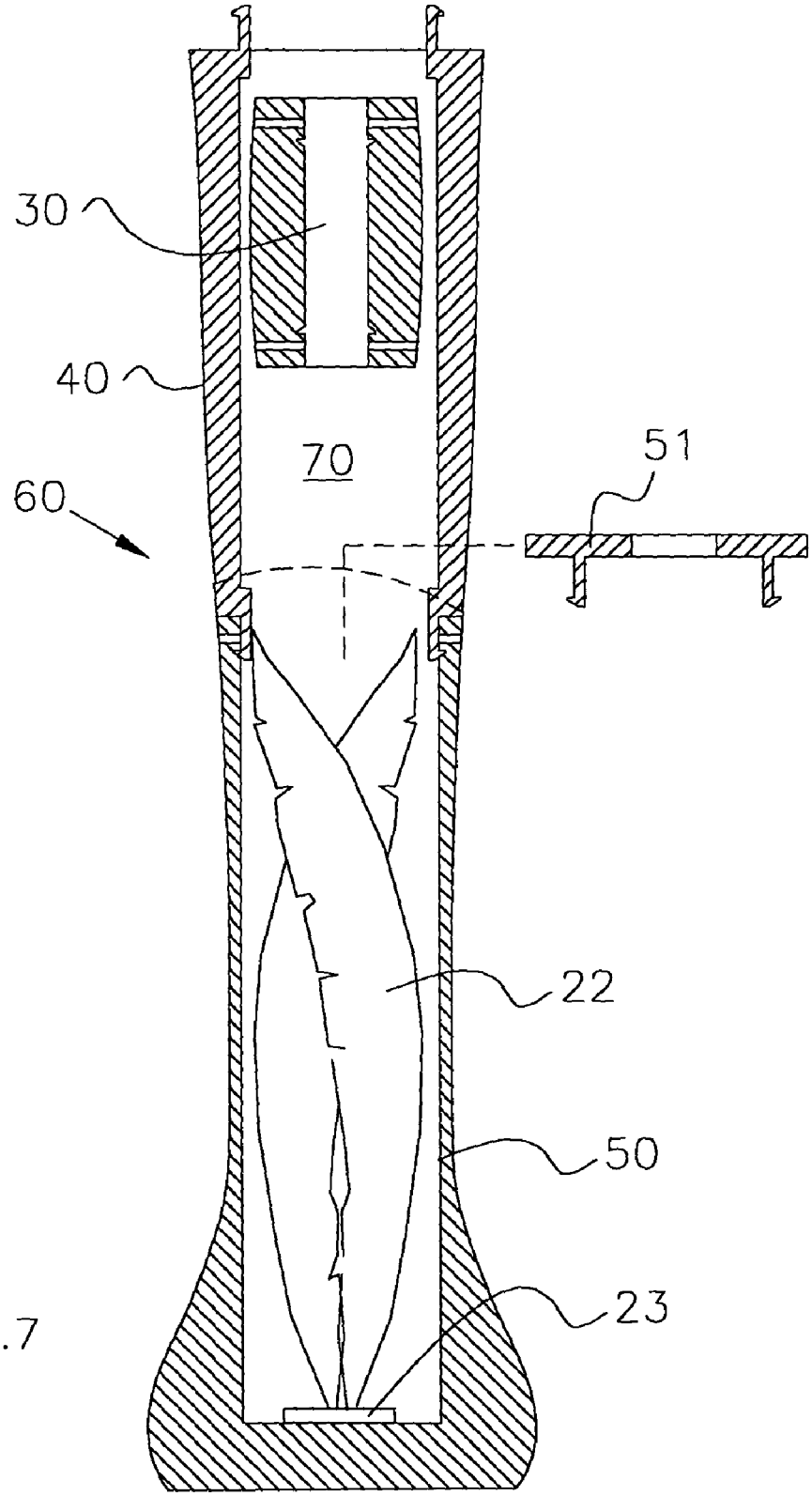
FIG. 7 shows the trunk section fully containing the leaf/canopy component and the first of the upper trunk sections being stored therein.

The leaf/canopy component 20 is attached to collar 23, which is too large to pass through the opening in cap 51. The restriction caused thereby facilitates the deployment of the leaf/canopy component 20 which had been stored previously in the base segment as shown in FIG. 7 to which reference is now made. Heart 30 is shown collapsed in diameter to allow it to pass inside trunk component 40, subsequently, trunk 40 would be collapsed similarly so as to enter space 70 and pass into base 50. In practice, the sequence of disassembly would be:

1. Separation of all trunk sections,
2. Collapse of leaf/canopy component 20, 3. Collapse of sections 30 and 40 and placement thereof within hollow area of base 50, 4. Placement of leaf/canopy component 20 within base section 50, 5. Placement of cap 51 over the top of base section 50.

Figure 4A:
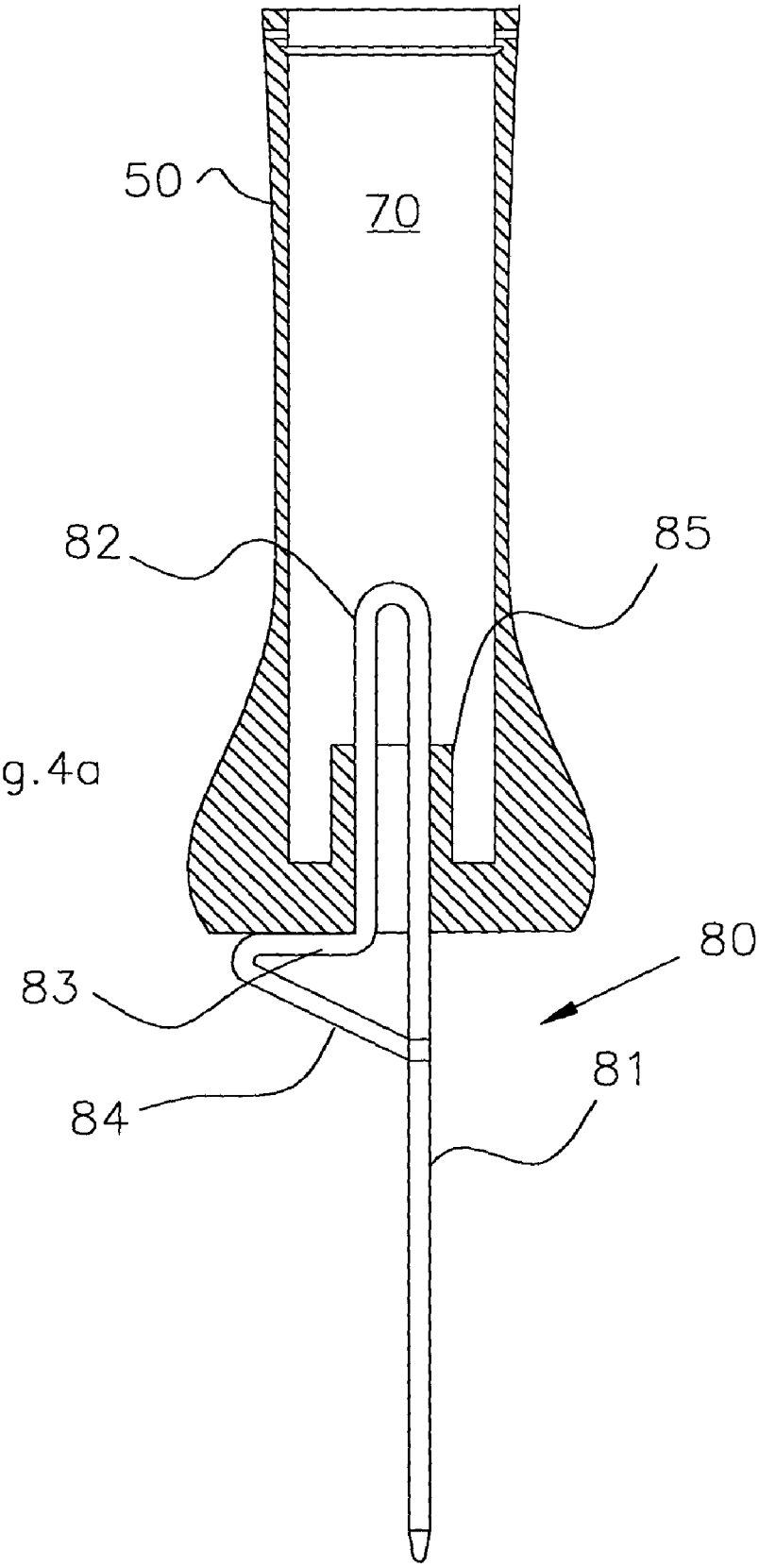
FIG. 4*a* is a sectional view of the base showing a sand anchor.
Figure 8:
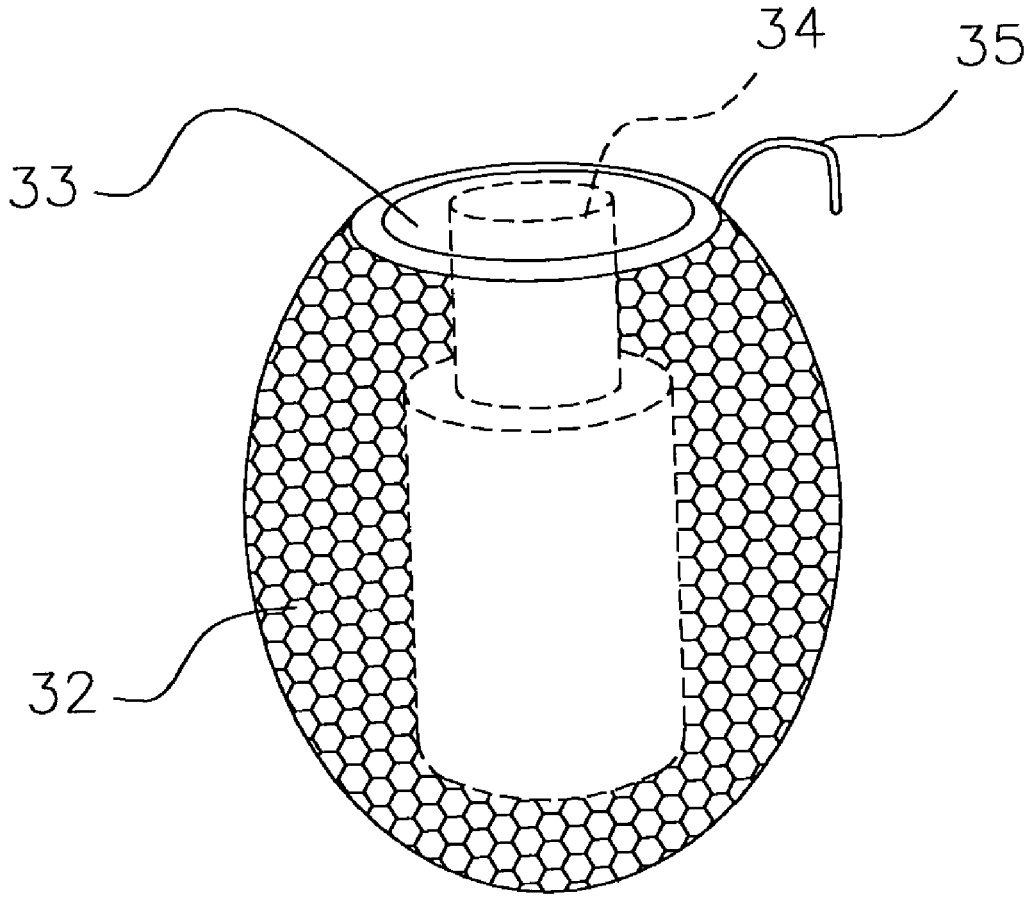
FIG. 8 is a sectional view of a cold drink receptacle formed to appear as a coconut.
Figure 9:
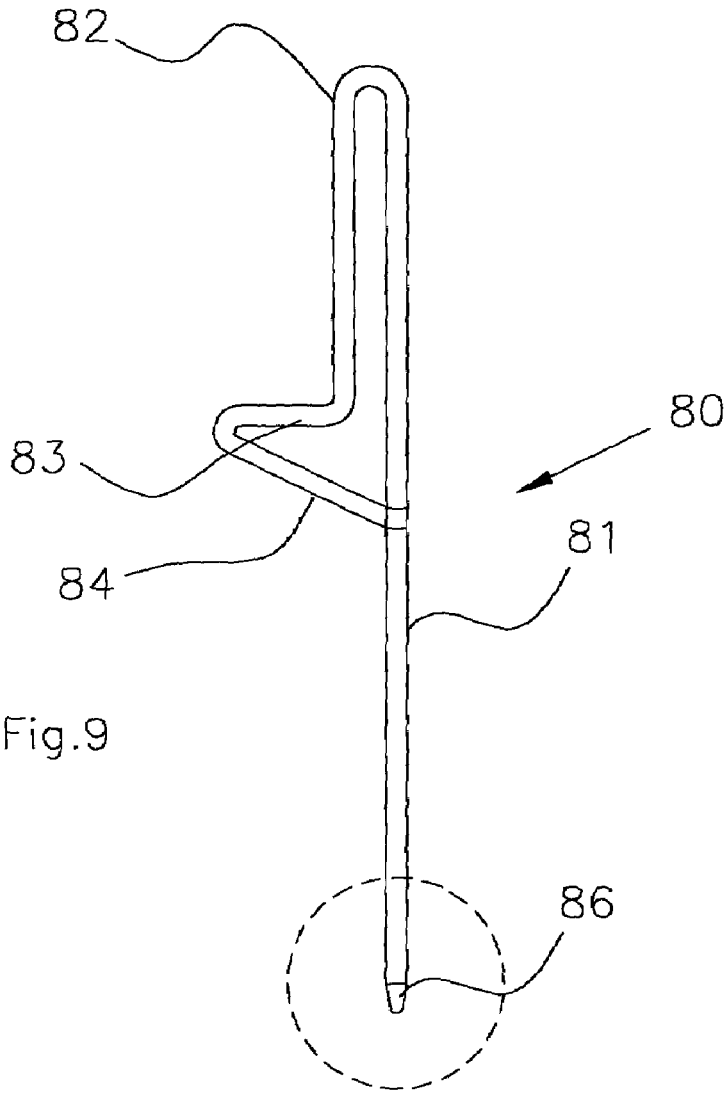
FIG. 9 is a side view of a sand anchor.
Figure 9A:
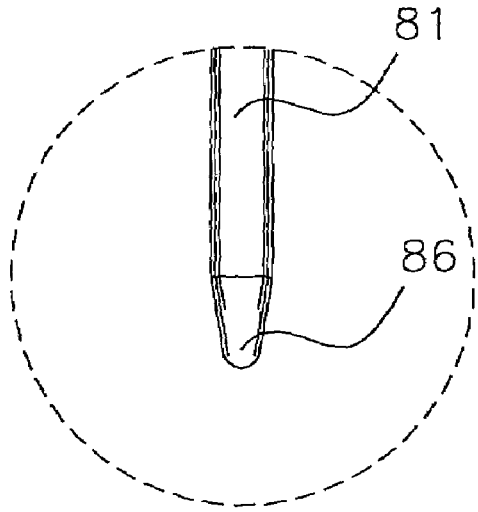
FIG. 9*a* is an exploded view of the tip of the sand anchor.

FIG. 8 illustrates the novel and characteristic coconut shaped cold drink receptacle which can be attached to the assembled tree by hooks 35. Container 32 is insulated 33 and holds one normal sized, long necked beer bottle 34 for example, FIGS. 9 and 9*a* show the details of a typical sand anchor 80 shown mounted in FIG. 4*a*. The sand grabber 80 consists of a long section of steel shaft 81 having a pointed first end 86, a 180° bend at a second end 82 and a step 83, having angled support section 84. The sand grabber 80 is shown as a device for stabilizing the portable, personal, palm tree 10 of the invention as shown in FIG. 4*a*.

The portable, personal, palm tree 10 of the invention, (PALMBRELLA™), will come in various shapes and sizes. The PALMBRELLA will be designed for use everywhere the beach umbrella and patio umbrella can be used. It will duplicate the look of a real palm tree. The base of the invention will be made in different sizes according to the palm tree which it is duplicating.

As shown in FIG. 6, the leaf/canopy 20 consists of the palm leaves 22 which are independently attached to collar 23. Each palm leaf 22 is a duplicate of a natural palm frond and consists of a flexible, fishing type pole to flex downwardly to duplicate natural palm fronds. In a preferred embodiment, 12 leaves would be used, however, other options include a greater number of leaves including, a second or third layer of leaves.

What is claimed is:

1. An artificial palm tree constructed from modular components which are combined in various ways to produce a palm tree having different characteristics for use as a beach umbrella, said palm tree comprising:

a base, said base having an upper end and a lower end, said lower end having a hollow protrusion formed therein to accommodate a sand grabber, and said upper end having a release aperture formed therein, a trunk being attached to said base, said trunk having an upper end and a lower end, said lower end having a male member formed thereon for mating with said upper end of said base and a male member formed on said upper end, a tree heart being attached to said trunk, said tree heart having a lower end and an upper end, said lower end and said upper end each having a release aperture formed therein, said base, trunk and tree heart being formed of a flexible, moldable substance having bark patterns embedded upon the outer surface, said trunk and said tree heart being split longitudinally for allowing said trunk and said tree heart to collapse to a smaller diameter for storage in said base, a cover being attached to said upper end of said tree heart, said cover having an upper end and a lower end, a male member formed on said lower end for mating with said upper end of said tree heart, said cover having an aperture formed in said upper end, and a plurality of palm leaves, each of said palm leaves duplicating a natural palm frond and having a fishing type pole base independently, pivotally attached at a first end to a collar for forming a canopy when fully extended and a compact mass when collapsed, said palm leaves being inserted through said cover aperture and held in an extended position by said collar.

* * * * *